US008322598B1

(12) United States Patent
Farentinos

(10) Patent No.: US 8,322,598 B1
(45) Date of Patent: Dec. 4, 2012

(54) MAILBOX MOUNTING BRACKET

(75) Inventor: Christopher A. Farentinos, Redondo Beach, CA (US)

(73) Assignee: Architectural Mailboxes, LLC., Redondo Beach, CA (US)

( * ) Notice: Subject to any disclaimer, the term of this patent is extended or adjusted under 35 U.S.C. 154(b) by 11 days.

(21) Appl. No.: 13/165,278

(22) Filed: Jun. 21, 2011

(51) Int. Cl.
*A47G 29/12* (2006.01)

(52) U.S. Cl. ..... 232/39; 248/131; 248/219.2; 248/415

(58) Field of Classification Search ..... 232/39, 232/17, 45; D99/32; 248/415, 417, 418, 248/349.1, 131, 125.7, 219.2
See application file for complete search history.

(56) References Cited

U.S. PATENT DOCUMENTS

| | | | | |
|---|---|---|---|---|
| 2,552,915 | A * | 5/1951 | Zachrich | 248/154 |
| 4,951,905 | A * | 8/1990 | Bronson et al. | 248/152 |
| 5,167,364 | A * | 12/1992 | Wenning | 232/39 |
| 5,337,954 | A * | 8/1994 | Kobilarcik et al. | 232/38 |
| 5,400,958 | A * | 3/1995 | Walker | 232/39 |
| 5,458,286 | A * | 10/1995 | Paschal | 232/39 |
| 5,603,580 | A | 2/1997 | Leek et al. | |
| 5,699,989 | A * | 12/1997 | Guthrie | 248/219.2 |
| 7,178,772 | B2 * | 2/2007 | Riker | 248/219.2 |
| 7,185,803 | B1 * | 3/2007 | Lutzke | 232/39 |
| 7,249,704 | B1 * | 7/2007 | Smith | 232/39 |
| 7,438,214 | B2 * | 10/2008 | Riker et al. | 232/39 |
| 7,497,368 | B2 * | 3/2009 | Lutzke | 232/39 |
| 7,992,767 | B1 * | 8/2011 | Holmes | 232/39 |

OTHER PUBLICATIONS

Solar Group, Universal Mounting Bracket, mounting instructions for model No. UMBS, 2 pages, Apr. 25, 2011 (however, applicant believes this product was publicly on sale at least as early as Mar. 2, 2011 in Atlanta, GA).

WWW.AMAZON.COM, web pages advertising Usp Structural Connectors 4×4 Rough Deck Bracket D44r-W Post Caps & Bases, 3 pages, Jun. 20, 2011 (however, applicant believes this product was publicly on sale at least as early as Jan. 7, 2011).

WWW.FLORIDAFASTENER.COM, web page advertising Simpson Strong-Tie BC4, 1 page, Jun. 20, 2011 (however, applicant believes this product was publicly on sale at least as early as Jan. 7, 2011).

WWW.SIGNSDIRECT.COM, web page advertising Street Sign Bracket for a 4"×4" Wood Post, 1 page, Jun. 20, 2011 (however, applicant believes this product was publicly on sale at least as early as Jan. 7, 2011).

WWW.AMERICANSALE.COM, web pages advertising Eden Pergola Bolt-Down Bracket System, 2 pages, Jun. 20, 2011 (however, applicant believes this product was publicly on sale at least as early as Jan. 7, 2011).

WWW.BESTNEST.COM, web pages advertising Audubon 4 ×4 Steel Mounting Bracket, 4 pages, Jun. 20, 2011 (however, applicant believes this product was publicly on sale at least as early as Jan. 7, 2011).

* cited by examiner

*Primary Examiner* — William L. Miller
(74) *Attorney, Agent, or Firm* — Vista IP Law Group LLP

(57) ABSTRACT

A mailbox mounting bracket is configured for attachment to a post, rail, fence, or the like, to allow a mailbox to be mounted in multiple orientations. The bracket has a top plate with a plurality of holes for mounting to the bottom of a mailbox, a downwardly-extending peripheral ridge with a plurality of holes for mounting to the sides of the mailbox, and first and second downwardly-extending flanges at opposite sides of the bracket each with a plurality of holes for mounting to opposite sides of the post, fence, rail or the like. In another embodiment, the bracket includes two pieces each having a top plate, the top plates being rotatably connected to each other for extra support and versatility.

26 Claims, 7 Drawing Sheets

MAILBOX MOUNTING BRACKET

FIELD OF THE INVENTION

The invention relates to mounting brackets, and more specifically to mounting brackets for mounting mailboxes to posts, fences, rails, or the like.

BACKGROUND

Mailboxes are often mounted to posts, fences, rails, and the like, using mounting brackets. For mounting on posts, the brackets typically have a width corresponding to the width of the post (typically approximately 3.5 inches) to allow mounting to the post, and a length longer than the width for mounting lengthwise to the underside of the mailbox. In other words, these typical post-mounting brackets are configured for mounting to the post such that the mailbox could then be mounted facing the desired direction, dictated by the bracket orientation. By mounting the bracket to the post in a specific lengthwise orientation (e.g., north-south or east-west), the mailbox mounted to the bracket thus faces the same desired direction. For mounting on rails, typically the rail is cantilevered, and the mailbox is mounted longitudinally on the rail. For mounting on fences, typically the mailbox is mounted transversely on the fence. Different brackets are typically required for these different types of mountings. Since it may be difficult to predict at which type of installation site a particular mailbox will be installed, brackets are often sold separately, and are thus not always available at the point of purchase of the mailbox.

It is thus desirable to have a single mailbox mounting bracket that could be used for a specific mailbox, regardless of whether the mailbox is to be installed on a post, fence, or rail.

SUMMARY

A mailbox mounting bracket is configured for attachment to a post, rail, fence, or the like, to allow a mailbox to be mounted in multiple orientations. With a substantially square-shaped bracket, for example, the mailbox may be mounted facing a first direction, or facing a second direction approximately 90 degrees clockwise from the first direction, or facing a third direction approximately 180 degrees clockwise from the first direction, or facing a fourth direction approximately 270 degrees clockwise from the first direction.

In one aspect of the invention, a mailbox mounting bracket has a top plate with a plurality of holes for mounting to the bottom of a mailbox, a downwardly-extending peripheral ridge with a plurality of holes for mounting to the sides of the mailbox, and first and second downwardly-extending flanges at opposite sides of the bracket substantially parallel to each other, each with a plurality of holes for mounting to opposite sides of a post, rail or fence or the like. The peripheral ridge and the flanges extend downwardly from the top plate substantially perpendicularly.

In other aspects of the invention, the top plate is substantially square-shaped and has cutouts along each side and/or the center and/or at each corner. The center cutout is preferably slightly less than approximately 3.5 inches by 3.5 inches square. The mounting holes (top and sides) are preferably all positioned substantially symmetrically about the center of the top plate, for example at the corners and/or intervals along the edges/sides.

In another aspect of the invention, the flanges extend downwardly from two opposite sides of the bracket approximately the same distance, which is farther downward than the peripheral ridge extends. In this manner, a channel is formed between the flanges under the top plate extending from one of the other two sides of the bracket to the other of the other two sides of the bracket.

In another aspect of the invention, the bracket is mounted to a mailbox having its own mounting holes on the bottom and sides, arranged in a pattern to match the top and side mounting holes of the bracket respectively. The bracket and mailbox may be mounted to a post, rail or fence or the like, through the post-mounting holes in the flanges.

The bracket may be made of a single piece of injection-molded plastic, metal, or other suitable composite material.

In another aspect of the invention, an embodiment includes two separate pieces with corresponding mating top plates for extra support and versatility. The bracket is a two-piece bracket with a male bracket piece and a female bracket piece configured to be positioned beneath the male piece and to mate therewith to create a rotatably connected two-piece bracket. In this embodiment, the male piece includes a male top plate having a substantially square-shaped upper surface with a plurality of top-mounting holes extending therethrough, and a substantially circular-shaped recessed center portion having a bottom surface. The recessed center portion extends downwardly and has at least one arc-shaped slot extending therethrough and positioned in radial alignment with the circumference of the circle. The male piece also includes a peripheral ridge extending downwardly and having a plurality of side-mounting holes extending therethrough. The peripheral ridge extends downwardly substantially perpendicularly, and to a distance not greater than the distance that the recessed center portion extends downwardly. The female piece includes a female top plate having a substantially square-shaped upper surface and at least one arc-shaped slot extending therethrough corresponding to the arc-shaped slot(s) of the male top plate. The female piece includes two flanges at opposite sides, extending downwardly substantially perpendicularly, and each having a plurality of post-mounting holes extending therethrough. In one aspect of this embodiment, hardware (such as bolts with washers and nuts) connects the male piece to the female piece through the corresponding arc-shaped slots, allowing the male piece and female piece to rotate relative to each other in a horizontal plane while connected. In one aspect of the two-piece embodiment, the male top plate and the peripheral ridge may have cutouts. In another aspect, there are four arc-shaped slots on the male piece, and four corresponding arc-shaped slots on the female piece.

BRIEF DESCRIPTION OF THE DRAWINGS

The foregoing and other aspects of embodiments are described in further detail with reference to the accompanying drawings, wherein.

DETAILED DESCRIPTION OF ILLUSTRATED EMBODIMENTS

Figure 6:
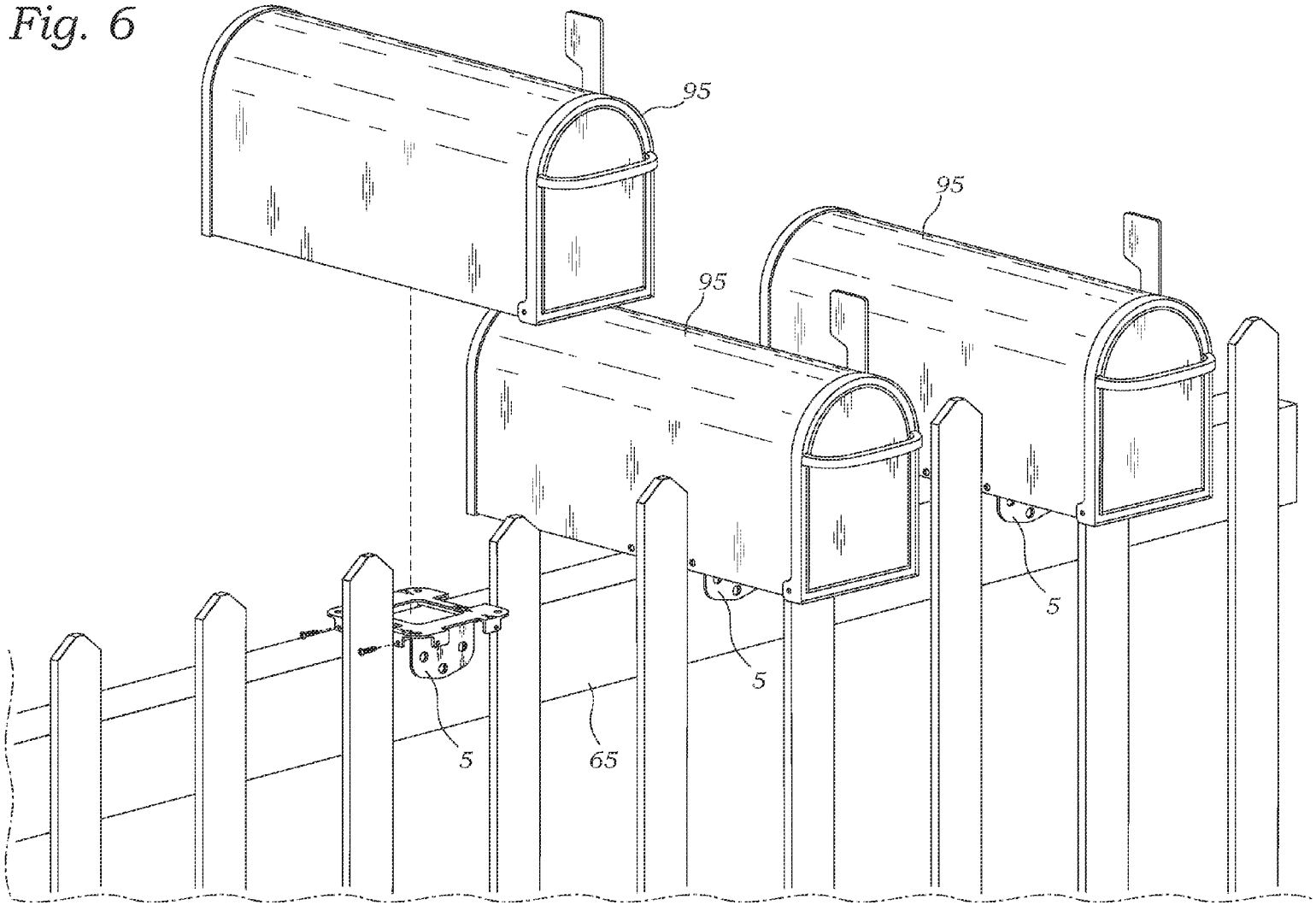
FIG. 6 is a perspective view showing multiple brackets of FIG. 1 positioned on a fence for mounting multiple mailboxes, in accordance with the present invention.

The invention relates to a mailbox mounting bracket for attachment to a post, rail, fence, or the like, to allow a mailbox to be mounted in multiple orientations depending on the mounting support for the mailbox, e.g., whether the mounting support is a post (see FIG. 3), rail (see FIG. 7), or fence (see FIG. 6).

Figure 1:
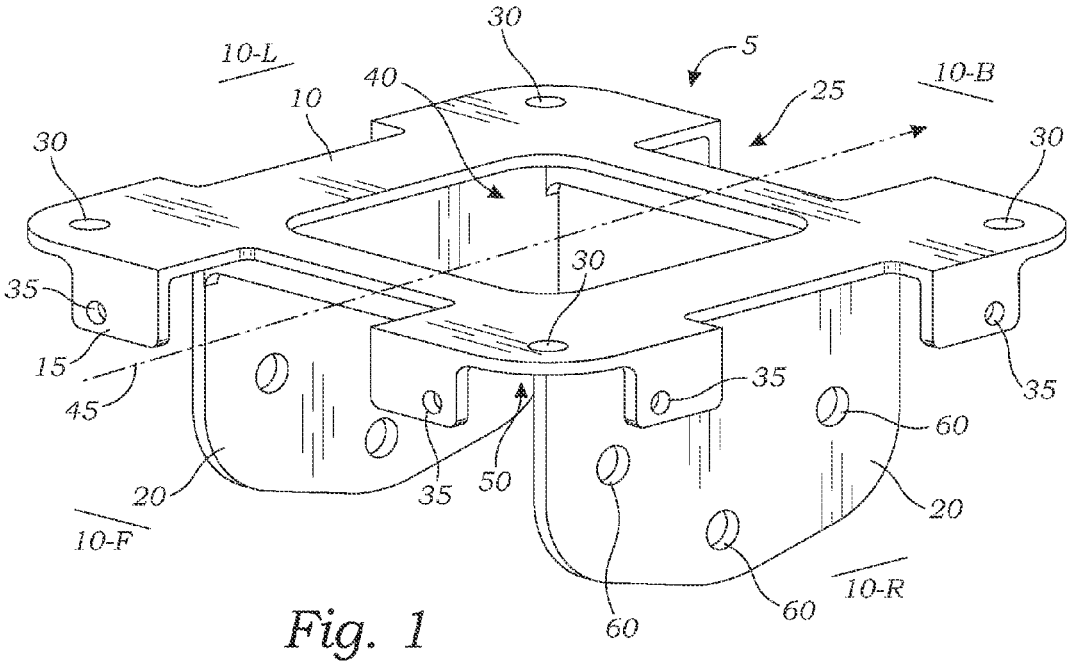
FIG. 1 is a perspective view of a first embodiment of a mailbox mounting bracket in accordance with the present invention.

Turning first to FIG. 1, a perspective view of a first embodiment of a mailbox mounting bracket (5) in accordance with the present invention is shown. The bracket (5) may be injection-molded from a single piece of plastic, or may be made of metal or other suitable composite material. The bracket (5) includes a top plate (10) having a plurality of top-mounting holes (30) extending therethrough for mounting the bracket (5) to the bottom of a mailbox (95) (see, e.g., FIG. 4). The top-mounting holes (30) are preferably positioned substantially symmetrically about the center of the top plate (10). For example, the top-mounting holes (30) can include at least one hole (30) positioned at each corner of the top plate (10).

The top plate (10) has a substantially flat top surface to receive a likewise substantially flat bottom surface of a mailbox (95), and a substantially flat bottom surface to receive a likewise substantially flat top surface of a mounting support. In other words, the top surface of the top plate (10) will be substantially flush against the bottom surface of the mailbox (95), and the bottom surface of the top plate (10) will be substantially flush against the top surface of the mounting support. However, the surfaces may be indented or formed to conform to the shape of the top surface of the mounting support. The top plate (10) is substantially square-shaped having a front side (10-F), a back side (10-B), a left side (10-L), and a right side (10-R), corresponding to front, back, left, and right sides of the bracket (5) respectively. In other words, the perimeter of the top plate (10) is defined by substantially a square, though the corners may be rounded, and there may be gaps or other irregularities in the edges. For example, the top plate (10) may have cutouts (25) along any or each of the front side (10-F), back side (10-B), left side (10-L), and right side (10-R). The cutouts (25) are optional, and are included to reduce material costs while still maintaining the structural integrity of the bracket (5), as well as to allow easier access to other parts of the bracket (5) during installation, repair, etc.

Figure 2:
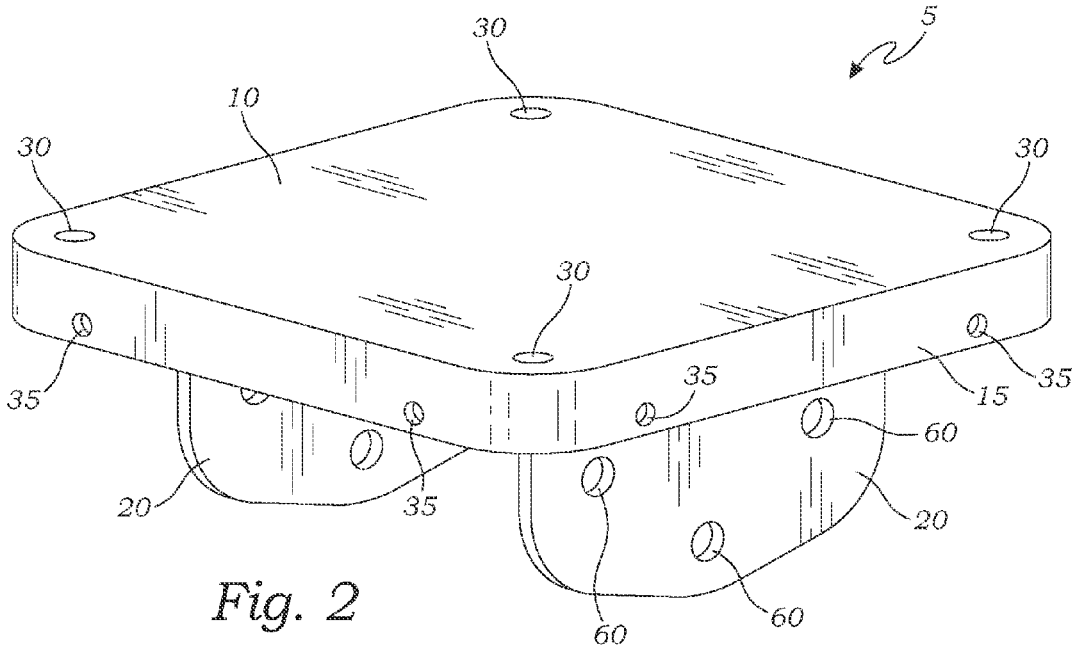
FIG. 2 is a perspective view of a second embodiment of a mailbox mounting bracket in accordance with the present invention, with no top plate cutouts and no peripheral ridge cutouts.

The top plate (10) also has an optional center cutout (40) in substantially the center, for the same reasons. Notably, as seen most clearly in FIG. 3, the mounting support for the mailbox (95) will typically have a top surface sufficient to provide any structural support that might otherwise be lacking due to the center cutout (40). Accordingly, the center cutout (40) may be shaped to accommodate the shape of the top of the mounting support, which in this example is square-shaped. Likewise, especially in the case of the mounting support being a post, the dimensions of the center cutout (40) may be slightly less than the dimensions of the top surface of the mounting support, since that would allow the bracket (5) to rest on the top of the mounting support without the mounting support passing therethrough. Instead of a center cutout (40), the top plate (10) may be molded or configured to include an indentation (not shown) on the underside to accommodate the top of the mounting support. FIG. 2 shows an embodiment of a bracket (5) in accordance with the present invention, without any top plate side cutouts and without any top plate center cutout.

Still referring to FIG. 1, the bracket (5) also has a peripheral ridge (15) extending downwardly from the top plate (10) to form a perimeter border, and having a plurality of side-mounting holes (35) extending therethrough for mounting the bracket (5) to the sides of a mailbox (95). The side-mounting holes (35) are preferably positioned substantially symmetrically about the center of the top plate (10). The peripheral ridge (15) extends downwardly from the top plate (10) substantially perpendicularly. The peripheral ridge (15) may have cutouts also, including corner cutouts (50), and cutouts along the sides corresponding to the top plate side cutouts (25). FIG. 2 shows an embodiment of a bracket (5) in accordance with the present invention, without any peripheral ridge cutouts.

The bracket (5) also has first and second flanges (20) extending downwardly from the top plate (10), having a plurality of post-mounting holes (60) extending therethrough for mounting the bracket (5) to a mounting support such as a post (55), fence (90), rail (65), or the like. The flanges (20) extend downwardly from the top plate (10) substantially perpendicularly, and are at opposite sides of the bracket (5) substantially parallel to each other. In this manner, the flanges (20) form a channel (45) extending under the top plate (10) for receiving the mounting support, such as a post (55), fence (90), rail (65) or the like. For example, if the flanges (20) are positioned at the front and back sides (10-F and 10-B) of the top plate (10) respectively, the channel (45) would extend from the left side (10-L) to the right side (10-R) of the top plate (10) between the flanges (20). The flanges (20) extend down farther than the peripheral ridge (15), and preferably sufficiently farther such that the peripheral ridge (15) does not impede access to the post-mounting holes (60). The flanges (20) typically should extend down approximately the same distance as each other, to maintain symmetry of the bracket (5), and should be configured to be substantially flush against the sides of the mounting support. However, the flanges (20) may be indented or formed to conform to the shape of the sides of the mounting support.

The flanges (20) should also extend downwardly from the top plate (10) sufficiently to allow adequate support and to allow mounting through post-mounting holes (60) low enough on the mounting support to further provide adequate structural support for the mailbox (95). For example, the flanges (20) should extend downwardly from the top plate (10) at least approximately 0.375 inches, and preferably between at least approximately 0.50 to 2.00 inches. Preferred ranges include between at least approximately: 1.00 to 3.00 inches; 1.00 to 2.75 inches; 1.00 to 2.50 inches; 1.00 to 2.25 inches; 1.00 to 2.00 inches; 1.00 to 1.75 inches; 1.00 to 1.50 inches; 1.00 to 1.25 inches; 1.25 to 3.00 inches; 1.25 to 2.75 inches; 1.25 to 2.50 inches; 1.25 to 2.25 inches; 1.25 to 2.00 inches; 1.25 to 1.75 inches; 1.25 to 1.50 inches; 1.25 to 3.00 inches; 1.50 to 3.00 inches; 1.75 to 3.00 inches; 2.00 to 3:00 inches; 2.25 to 3.00 inches; 2.50 to 3.00 inches; 2.75 to 3.00 inches; 1.25 to 2.75 inches; 1.50 to 2.75 inches; 1.75 to 2.75 inches; 2.00 to 2:75 inches; 2.25 to 2.75 inches; and 2.50 to 2.75 inches.

Correspondingly, the post-mounting holes (60) should be sufficiently vertically distant from the top plate (10). For example, the post-mounting holes (60) should be below the top plate (10) by at least approximately 0.375 inches, and preferably between at least approximately 0.50 to 3.00 inches. Preferred ranges include between at least approximately: 1.00 to 3.00 inches; 1.00 to 2.75 inches; 1.00 to 2.50 inches; 1.00 to 2.25 inches; 1.00 to 2.00 inches; 1.00 to 1.75 inches; 1.00 to 1.50 inches; 1.00 to 1.25 inches; 1.25 to 3.00 inches; 1.25 to 2.75 inches; 1.25 to 2.50 inches; 1.25 to 2.25 inches; 1.25 to 2.00 inches; 1.25 to 1.75 inches; 1.25 to 1.50 inches; 1.25 to 3.00 inches; 1.50 to 3.00 inches; 1.75 to 3.00 inches; 2.00 to 3:00 inches; 2.25 to 3.00 inches; 2.50 to 3.00 inches; 2.75 to 3.00 inches; 1.25 to 2.75 inches; 1.50 to 2.75 inches; 1.75 to 2.75 inches; 2.00 to 2:75 inches; 2.25 to 2.75 inches; and 2.50 to 2.75 inches.

Figure 3:
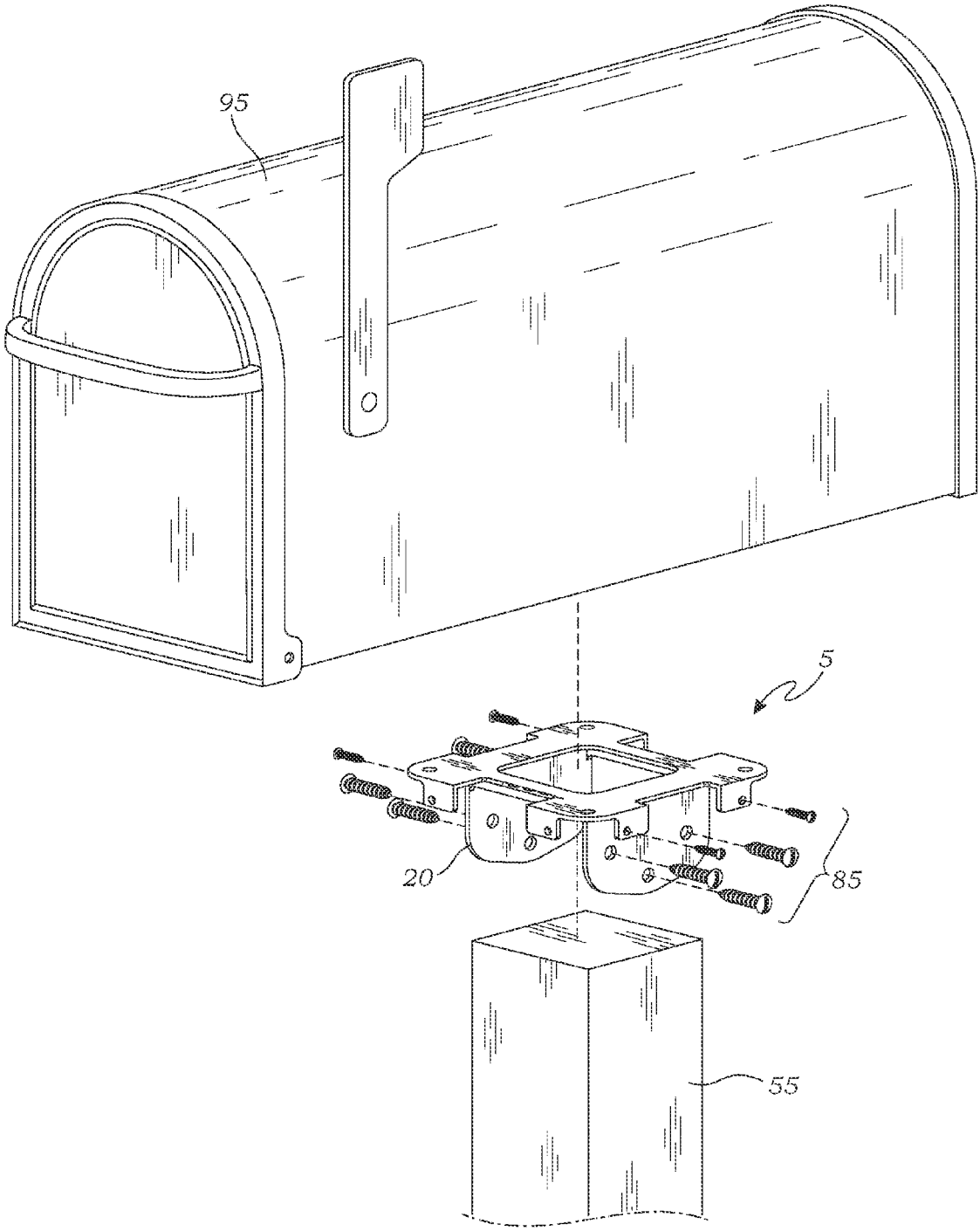
FIG. 3 is an expanded perspective view showing the bracket of FIG. 1 in position to mount a mailbox on a post in accordance with the present invention.

Turning now to FIG. 3, an expanded perspective view is shown of the bracket (5) of FIG. 1 in position to mount a mailbox (95) on a post (55) in accordance with the present invention. The bracket (5) is mounted to the post (55) and to mailbox (95) using any suitable fasteners (85) such as screws. Fasteners (85) are used to mount the mailbox (95) to the bracket (5) by some extending through the top-mounting holes (30) of the top plate (10) and the bottom-mounting holes of the mailbox (95), and by others extending through the side-mounting holes (35) of the peripheral ridge (15) and the side-mounting holes (80) of the mailbox (95). The bracket (5) is mounted to a mounting support such as a post (55), fence (90), or rail (65) by fasteners (85) extending through the post-mounting holes (60) in the flanges (20), and into the post (55), fence (90) or rail (65) as seen in FIGS. 5 and 6.

Figure 4:
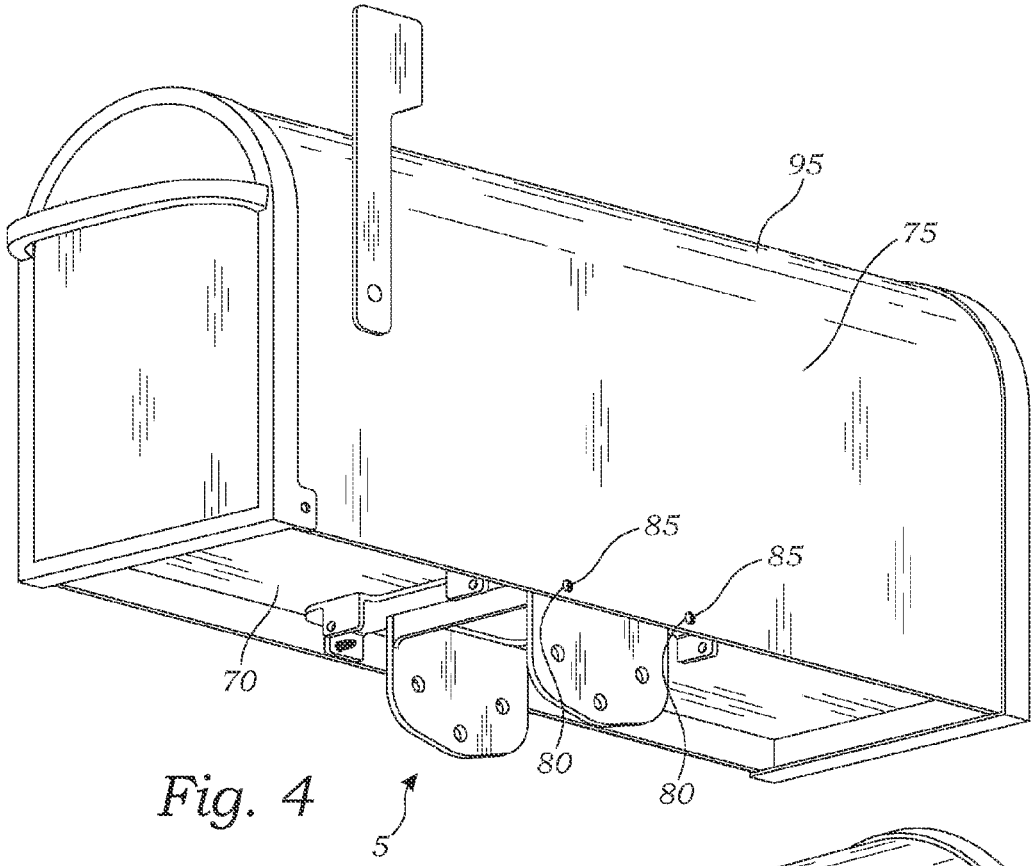
FIG. 4 is a perspective view showing the bracket of FIG. 1 mounted to the bottom of a mailbox in accordance with the present invention.

For reference in this FIG. 3, presume the bracket (5) is oriented in a first initial position, i.e., facing an initial direction. In this example, the bracket (5) may be oriented to face a second direction approximately 90 degrees clockwise from the first direction, or a third direction approximately 180 degrees clockwise from the first direction, or a fourth direction approximately 270 degrees clockwise from the first direction. Due to the symmetry of the bracket (5) (including the top-mounting holes 30 and the side-mounting holes 35), any of those orientations would still permit the bracket (5) to be mounted to the post (55), and the mailbox (95) to be mounted to the bracket (5). Indeed, due to the symmetry of this embodiment of the bracket (5) of the present invention, and the fact that the mounting support in this example is a post (55), the mailbox (95) could be mounted to face any of the four different directions. FIG. 4 shows a perspective view of the bracket (5) of FIG. 1, mounted to the bottom (70) of the mailbox (95), and FIG. 5 shows the same bracket (5) and mailbox (95) of FIG. 4 mounted to a post (55).

Figure 5:
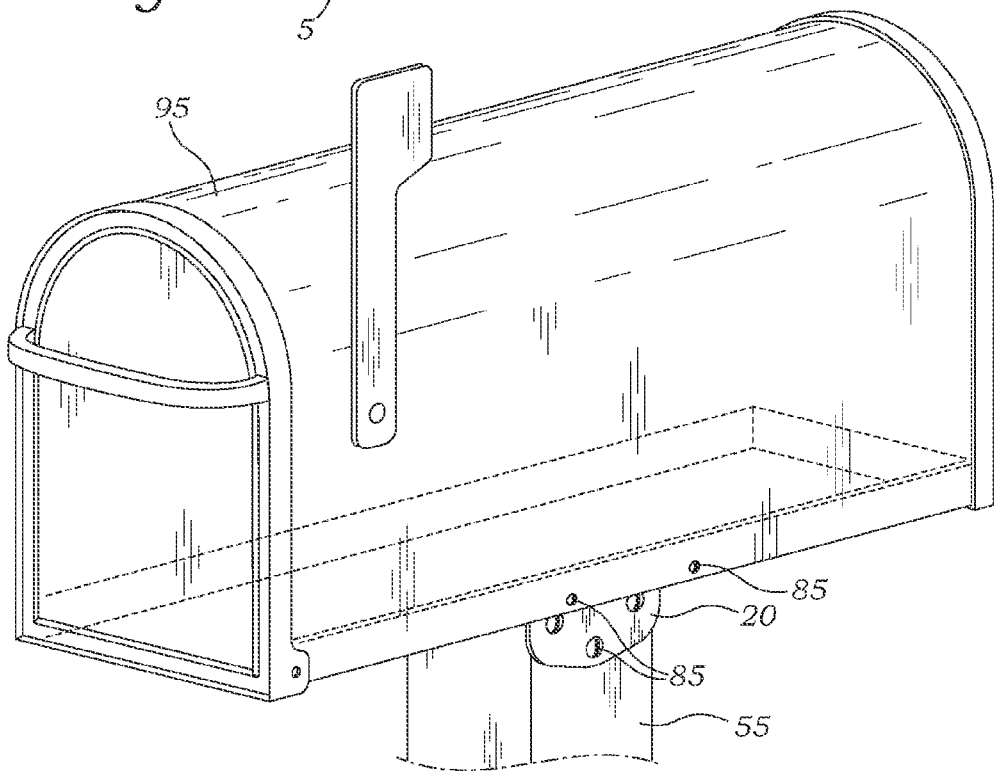
FIG. 5 is a perspective view showing the bracket and mailbox of FIG. 4 mounted to a post in accordance with the present invention.

The mailbox of FIGS. 4 and 5 has a bottom (70) with bottom-mounting holes (not shown) and sides (75) with side-mounting holes (80). Such mailbox mounting holes are not necessary, but if arranged properly can simplify installation and mounting of the bracket (5). For example, the mailbox mounting holes may be arranged in patterns to match the mounting holes (30, 35) of the bracket (5), such that the bottom-mounting holes of the mailbox (95) correspond to the top-mounting holes (30) of the top plate (10), and the side-mounting holes (80) of the mailbox (95) correspond to the side-mounting holes (35) of the peripheral ridge (15). The bracket (5) may even have multiple sets of mounting holes (30 and 35) to accommodate various patterns of mailbox mounting holes that may be present in various models of mailboxes (95).

Turning now to FIG. 6, a perspective view is shown of multiple brackets (5) positioned on a fence (90) for mounting multiple mailboxes (95). This FIG. 6 exemplifies one of the advantages of the bracket (5) of the present invention, namely that the same bracket (5) can be used to mount mailboxes to posts (55) as seen in FIGS. 3 and 5, or to a fence (90) as seen in FIG. 6. For mounting to fences (90) or rails (65), the brackets (5) are restricted to one of two possible orientations (e.g., initial and 180 degrees), as opposed to one of four possible orientations discussed above regarding FIG. 3 (e.g., initial, 90 degrees, 180 degrees, and 270 degrees). In other words, the fence (90) or rail (65) is received in the channel (45) such that the flanges (20) encompass the outsides of the fence (90) or rail (65), but due to the horizontal length of the fence (90) or rail (65), the bracket (5) cannot be positioned at 90 degrees or 270 degrees from the initial position. This restriction, however, does not affect the versatility of the bracket (5), because the bracket (5) still accommodates the desired orientation of the mailbox (95), as is seen in FIG. 6 and FIG. 7.

Figure 7:
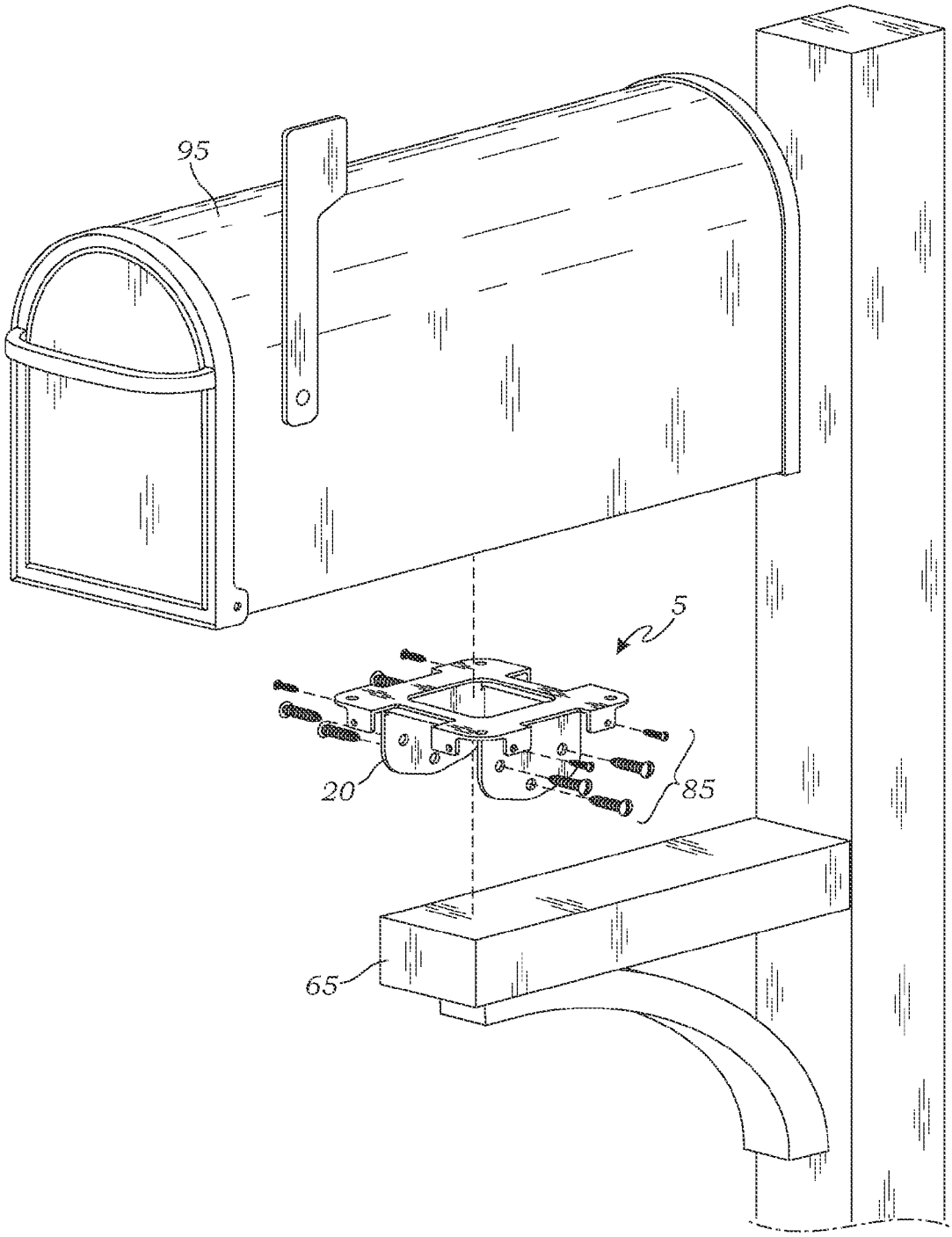
FIG. 7 is an expanded perspective view showing the bracket of FIG. 1 in position to mount a mailbox on a cantilevered rail in accordance with the present invention.

Turning now to FIG. 7, an expanded perspective view is shown of a bracket (5) of FIG. 1 in position to mount a mailbox (95) on a cantilevered rail (65) in accordance with the present invention. This is similar to FIG. 3, but shows the bracket (5) being mounted on a rail (65) instead of on a post (55).

Figure 8:
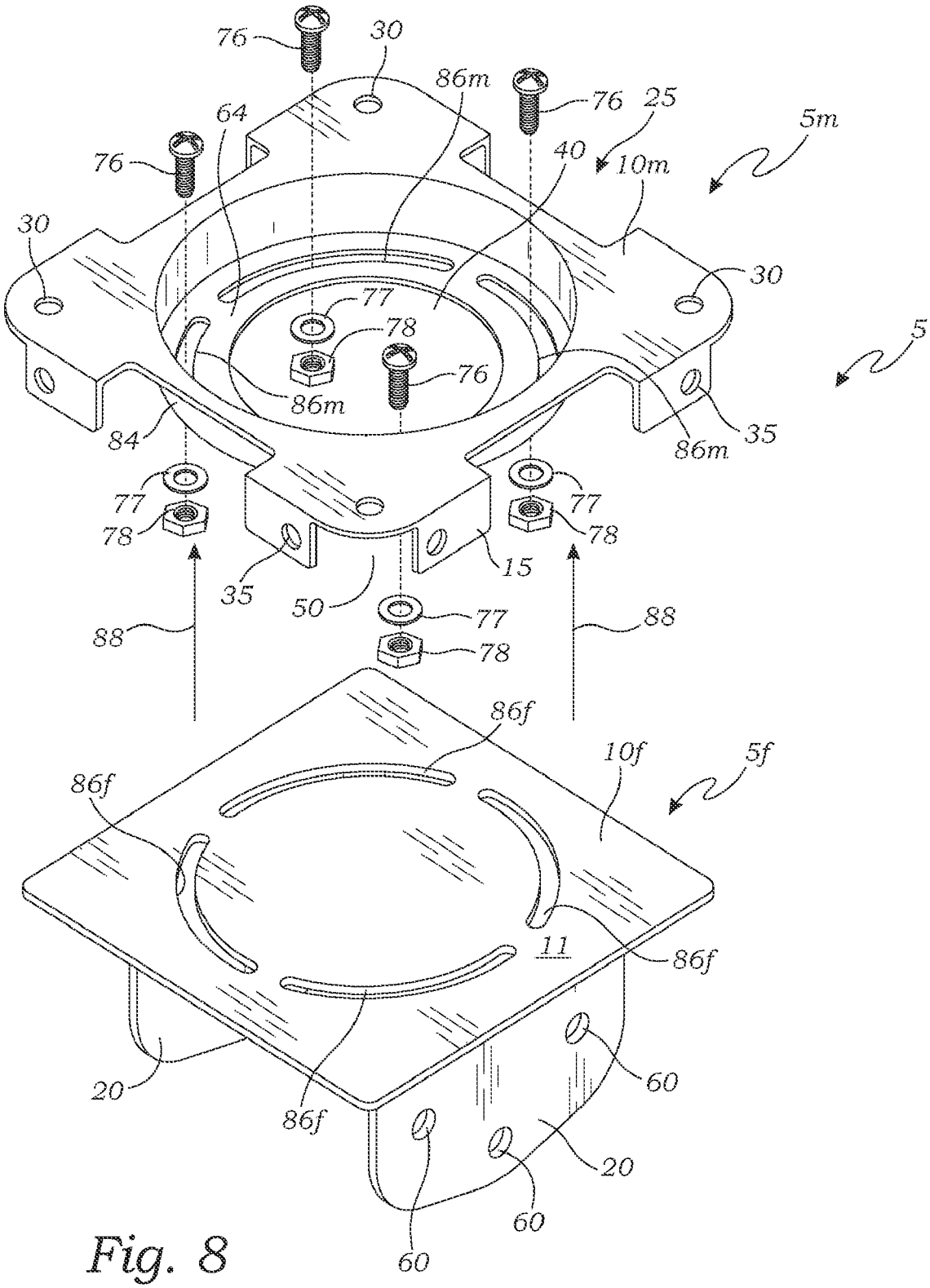
FIG. 8 is a perspective view of a third embodiment of a mailbox mounting bracket in accordance with the present invention, with two separate pieces having corresponding mating top plates for extra support and versatility.

Turning now to FIG. 8, a perspective view of a third embodiment of a mailbox mounting bracket (5) in accordance with the present invention, with two separate bracket pieces (5*m*, 5*f*) having corresponding mating top plates (10*m*, 10*f*) for extra support and versatility. Hardware (76, 77, 78) connects the male bracket piece (5*m*) to the female bracket piece (5*f*) as described herein.

Figure 9A:
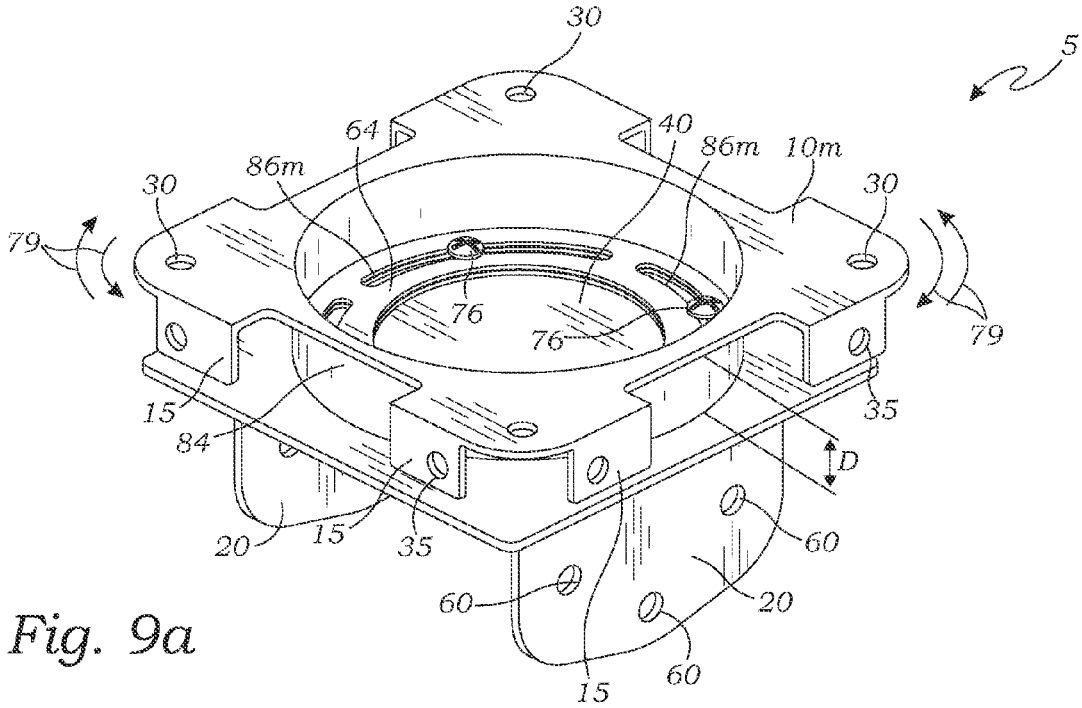
FIG. 9*a* shows the bracket of FIG. 8 with the two separate pieces secured in geometric alignment.
Figure 9B:
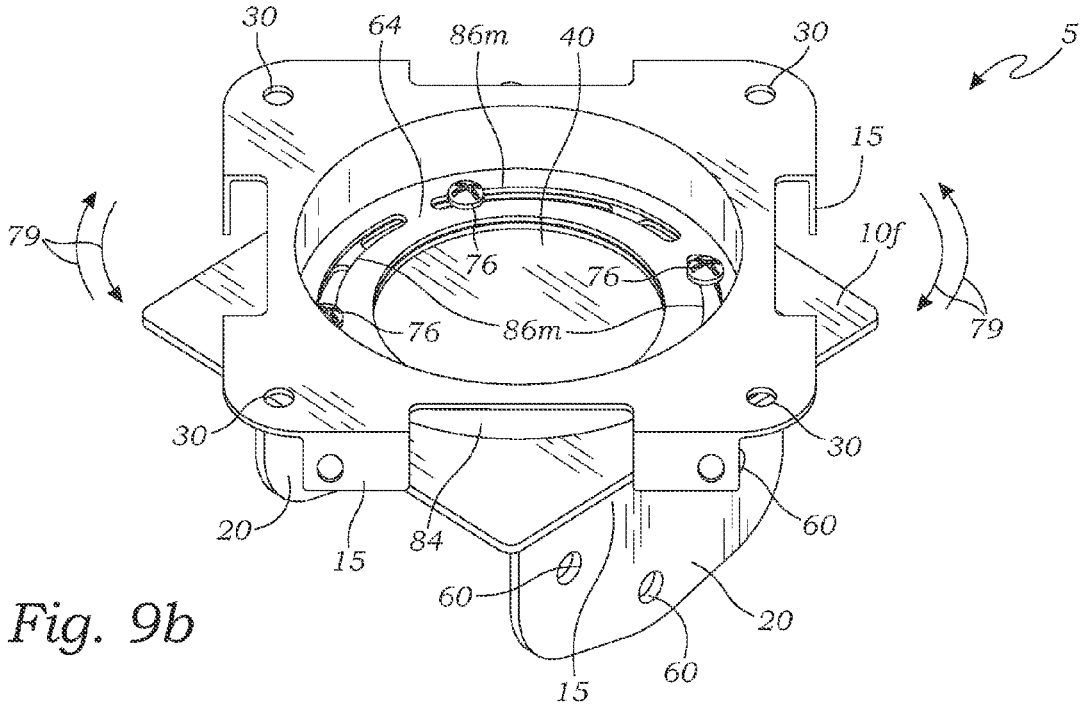
FIG. 9*b* shows the bracket of FIG. 9*a* with the two separate pieces secured at a displacement angle of approximately 45 degrees.

The male bracket piece (5*m*) includes a male top plate (10*m*) having substantially square-shaped upper surface, and a plurality of top-mounting holes (30) extending therethrough, with or without cutouts as previously described. Likewise, a peripheral ridge (15) is as previously described, either with or without cutouts. FIG. 8 shows an embodiment with corner cutouts (50), side cutouts (25), and a center cutout (40). In this embodiment, the male bracket piece (5*m*) also has a substantially circular-shaped recessed center portion (64) extending downwardly from the male top plate (10*m*) to a distance (D), with at least one arc-shaped slot (86*m*) extending therethrough. The embodiment in FIG. 8 has four such slots (86*m*), of which three are visible. The slots (86*m*) are positioned in radial alignment with the circumference of the circular-shaped recessed center portion (64), i.e., the curvature of the slots (86*m*) follows the curvature of the circle. The slots (86*m*) are preferably arc-shaped and positioned as arcs on a single circle, but they may be other shapes, and even if arc-shaped, may be positioned as parts of concentric circles or in other orientations. The bottom surface (not shown) of the recessed portion (64) is substantially flat to cooperate with the female bracket piece (5*f*) as described herein. The peripheral ridge (15) extends downwardly from the male top plate (10*m*) substantially perpendicularly, to a distance that is not greater than the distance (D). As such, when the male bracket piece (5*m*) is placed on top of the female bracket piece (5*f*) (see, e.g., FIGS. 9*a*, 9*b*), the bottom surface of the recessed center portion (64) may rotate clockwise and/or counterclockwise within the plane of the upper surface (11) of the female top plate (100, without being limited by the ridge (15) hitting the edge of the male top plate (10*m*). The rotation is represented by arrows (79), and FIG. 9*b* shows the rotation to an angle of displacement of approximately 45 degrees from the position shown in FIG. 9*a*.

The female bracket piece (5*f*) includes a female top plate (10*f*) having a substantially square-shaped upper surface (11) and at least one arc-shaped slot (860 extending therethrough corresponding to the arc-shaped slot(s) (86*m*) of the male top plate (10*m*). In other words, when the male bracket piece (5*m*) is placed on top of the female bracket piece (5*f*) in geometric alignment as seen in FIG. 9*a*, the slots (86*f*) match up substantially with the slots (86*m*). The female bracket piece (5*f*) also includes first and second flanges (20) extending downwardly substantially perpendicularly, and having a plurality of post-mounting holes (60) extending therethrough. The flanges (20) are at opposite sides of the female bracket piece (5*f*) from each other.

The male piece (5*m*) and female piece (5*f*) are connected by hardware (76-78). The hardware preferably is nuts (78) bolts (76) and washers (77), one set for each of the pairs of slots (86*m*, 860, as seen in FIG. 8. The pieces (5*m*, 5*f*) are bolted together by the hardware (76-78) through the slots (86*m*, 860, such that the bottom surface of the recessed center portion (64) of the male top plate (10*m*) rests upon and intersects the upper surface (11) of the female top plate (10*f*). The intersection is referred to herein as the horizontal plane of connection. Rotation of the two pieces (5*m*, 5*f*) relative to each other along these surfaces in a clockwise and/or counterclockwise direction as indicated by arrows 79, is considered rotation in the horizontal plane of connection. This allows a mailbox (95) to be oriented as desired on a mounting support.

Specifically, although the two-piece embodiment may be used for applications similar to the other embodiments, it is also convenient for situations in which the mailbox (95) is to be oriented at an angle that is not perpendicular to the mounting support. For example, a mounting support may not be secured at a right angle to the street, due to improper construction, physical restraints, or architectural design. But in such cases, it may still be desirable to orient the front of a mailbox (95) to face the street. This is possible with the two-piece embodiment. Once the male bracket piece (5*m*) is connected to the female bracket piece (5*f*) using hardware (76-78), the desired angle of displacement may be set by loosening the hardware and making necessary rotational adjustments, by rotating the bracket pieces (5*m*, 5*f*) relative to each other in the horizontal plane of connection. The two pieces (5*m*, 5*f*) would still be connected during the adjustment, but just not as tightly as when they are secured for actual use with a mailbox (95). FIG. 9*a* shows no displacement, i.e., the pieces (5*m*, 5*f*) are secured in geometric alignment. This configuration could be used for applications similar to the other embodiments, in which the mailbox (95) faces at a right angle to the mounting support. FIG. 9*b*, however, shows a displacement angle of approximately 45 degrees. It should be apparent that in the configuration seen in FIG. 9*b*, the mailbox (95) would face an angle of approximately 45 degrees offset from the mounting post orientation. That is because the male bracket piece (5*m*) would be attached to the mailbox (95), while the flanges (20) of the female bracket piece (5*f*) would be attached to the mounting support, the two pieces (5*m*, 5*f*) being offset at about 45 degrees.

Other variations and benefits of the mounting bracket of the present invention will be apparent to those of ordinary skill in this field, based on their experience combined with the teachings of this patent. For example, the quantities and locations of the different types of mounting holes may vary. Also for example, a substantially circular-shaped bracket with corresponding curved flanges and substantially symmetrically arranged mounting holes (top, side, and/or post) could be used to allow a mailbox to be mounted to a circular post in multiple orientations. In addition, other hardware may be used besides nuts, bolts, and washers. Examples include screws, pins and holes, protrusions and detents, tabs and slots, clips, clamps, and corresponding interlocking teeth or gears, or other hardware to allow rotational adjustment and then securement. Also, other regular geometrically-shaped brackets could be used for mounting in multiple directions on correspondingly shaped posts.

A new mailbox mounting bracket has thus been described, along with certain benefits and uses.

What is claimed is:

1. A mailbox mounting bracket comprising:

a top plate having a plurality of top-mounting holes extending therethrough;

a peripheral ridge extending downwardly from an outer periphery of the top plate, having a plurality of side mounting holes extending therethrough, the peripheral ridge extending downwardly from the top plate substantially perpendicularly;

a first flange extending downwardly from the top plate, having a plurality of postmounting holes extending therethrough, the first flange extending downwardly from the top plate substantially perpendicularly;

a second flange extending downwardly from the top plate, having a plurality of postmounting holes extending therethrough, the second flange extending downwardly from the top plate substantially perpendicularly;

wherein the first flange and the second flange are at opposite sides of the bracket, and are substantially parallel to each other.

2. The bracket of claim 1, wherein the top plate is substantially square-shaped having a front side, a back side, a left side, and a right side.

3. The bracket of claim 2, wherein the top plate has cutouts along each of the front side, the back side, the left side, and the right side.

4. The bracket of claim 3, wherein the top plate has a substantially square-shaped center cutout.

5. The bracket of claim 3, wherein the peripheral ridge has cutouts at each corner.

6. The bracket of claim 5, wherein the top plate has a substantially square-shaped center cutout.

7. The bracket of claim 6, wherein the bracket is comprised of a single piece of injection-molded plastic.

8. The bracket of claim 6, wherein the plurality of top-mounting holes includes at least one hole positioned at each corner of the top plate.

9. The bracket of claim 6, wherein the plurality of top-mounting holes are positioned substantially symmetrically about the center of the top plate, and the plurality of side-mounting holes are positioned substantially symmetrically about the center of the top plate.

10. The bracket of claim 2, wherein the peripheral ridge has cutouts at each corner.

11. The bracket of claim 10, wherein the top plate has a substantially square-shaped center cutout.

12. The bracket of claim 2, wherein the top plate has a substantially square-shaped center cutout slightly less than approximately 3.5 inches by 3.5 inches.

13. The bracket of claim 2, wherein the plurality of top-mounting holes are positioned substantially symmetrically about the center of the top plate, and the plurality of side-mounting holes are positioned substantially symmetrically about the center of the top plate.

14. The bracket of claim 2, wherein the first flange and the second flange extend downwardly from the front side and back side of the bracket respectively, and form a channel therebetween under the top plate extending from the left side of the bracket to the right side of the bracket.

15. The bracket of claim 14, wherein the first flange and the second flange extend downwardly approximately the same distance.

16. The bracket of claim 1, in combination with a mailbox, said mailbox having a bottom with mailbox bottom-mounting holes, and sides with mailbox side-mounting holes;

wherein the plurality of top-mounting holes of the top plate are arranged in a pattern to match the bottom-mounting holes of the mailbox;

wherein the plurality of side-mounting holes of the peripheral ridge are arranged in a pattern to match the side-mounting holes of the mailbox; and wherein the mailbox is mounted to the bracket with fasteners extending through the top-mounting holes of the top plate and the bottom-mounting holes of the mailbox, and with fasteners extending through the side-mounting holes of the peripheral ridge and the side-mounting holes of the mailbox.

17. The bracket and mailbox of claim 16, wherein the bracket is mounted to a post by fasteners extending through the plurality of post-mounting holes in the first flange and by other fasteners extending through the plurality of post-mounting holes in the second flange.

18. The bracket and mailbox of claim 17, wherein a top surface of the top plate is substantially flush against the bottom of the mailbox, a bottom surface of the top plate is substantially flush against a top surface of the post, the first flange is substantially flush against a first side of the mounting support, and the second flange is substantially flush against a second opposite side of the mounting support.

19. The bracket and mailbox of claim 16, wherein the bracket is mounted to a rail by fasteners extending through the plurality of post-mounting holes in the first flange and by other fasteners extending through the plurality of post-mounting holes in the second flange.

20. The bracket of claim 1, wherein the first flange and the second flange extend downwardly farther than the peripheral ridge extends downwardly, and between at least approximately 0.50 inches to 2.00 inches from the top plate.

21. The bracket of claim 20, wherein the post-mounting holes on the first flange are positioned between at least approximately 0.50 inches to 3.00 inches below the top plate.

22. A mailbox mounting bracket comprising:

a male bracket piece;

a female bracket piece; and hardware for connecting the male bracket piece to the female bracket piece in a manner that allows the male bracket piece to rotate relative to the female bracket piece in a horizontal plane of connection while connected;

wherein the male bracket piece comprises:

a) a male top plate having a substantially square-shaped upper surface with a plurality of top-mounting holes extending therethrough, and a substantially circular-shaped recessed center portion having a bottom surface, the recessed center portion extending downwardly from the male top plate to a first distance and having at least one arc-shaped slot extending therethrough positioned in radial alignment with the circumference of the circular shaped recessed center portion; and b) a peripheral ridge extending downwardly from an outer periphery of the male top plate and having a plurality of side-mounting holes extending therethrough, the peripheral ridge extending downwardly from the male top plate substantially perpendicularly to a second distance not greater than the first distance;

wherein the female bracket piece comprises:

a) a female top plate having a substantially square-shaped upper surface and at least one arc-shaped slot extending therethrough corresponding to the at least one arc-shaped slot of the male top plate;

b) a first flange extending downwardly from the female top plate substantially perpendicularly, and having a plurality of post-mounting holes extending therethrough; and c) a second flange extending downwardly from the female top plate substantially perpendicularly, and having a plurality of post-mounting holes extending therethrough, the second flange being at a side of the female bracket piece opposite the first flange.

23. The bracket of claim 22, wherein the male top plate further comprises cutouts along each of a front side, a back side, a left side, and a right side, and a center cutout; and wherein the peripheral ridge has cutouts at each of the four corners of the mail top plate.

24. The bracket of claim 22, wherein the male bracket piece is connected to the female bracket piece by the hardware through the at least one arc-shaped slot of the male bracket piece and the corresponding at least one arc-shaped slot of the female bracket piece, the bottom surface of the recessed center portion of the male top plate intersecting the upper surface of the female top plate at the plane of connection.

25. The bracket of claim 22, wherein the at least one arc-shaped slot of the male bracket piece comprises at least four arc-shaped slots, and wherein the at least one arc-shaped slot of the female bracket piece comprises at least four arc-shaped slots corresponding to the at least four arc-shaped slots of the male bracket piece.

26. The bracket of claim 25, wherein the at least four arc-shaped slots of the male bracket are arcs of a single circle.

* * * * *